US010731361B2

(12) United States Patent
Rogers

(10) Patent No.: US 10,731,361 B2
(45) Date of Patent: Aug. 4, 2020

(54) METHOD OF BIASING A DRYWALL CORNER FLUSHER AND A DRYWALL CORNER FLUSHER

(71) Applicant: Can-Am Tool Corp., Sturgeon County (CA)

(72) Inventor: James W Rogers, Toronto (CA)

(73) Assignee: CAN-AM TOOL CORP., Sturgeon County (CA)

( * ) Notice: Subject to any disclaimer, the term of this patent is extended or adjusted under 35 U.S.C. 154(b) by 1 day.

(21) Appl. No.: 16/288,691

(22) Filed: Feb. 28, 2019

(65) Prior Publication Data

US 2019/0271166 A1 Sep. 5, 2019

(30) Foreign Application Priority Data

Mar. 5, 2018 (CA) ..... 2997305

(51) Int. Cl.
*E04F 21/165* (2006.01)

(52) U.S. Cl.
CPC ..... *E04F 21/1655* (2013.01); *E04F 21/1652* (2013.01)

(58) Field of Classification Search
CPC .. E04F 21/1655; E04F 21/1652; E04F 21/165
USPC ..... D8/45; 15/235.7, 235.8, 235.4, 235.5, 15/235.6, 245.1; 451/354, 495, 514
See application file for complete search history.

(56) References Cited

U.S. PATENT DOCUMENTS 3,932,101 A 1/1976 Johnson et al.
4,116,604 A 9/1978 Johnson et al.
4,767,297 A 8/1988 Mower et al.
5,010,618 A 4/1991 Croft
5,240,394 A 8/1993 James
5,263,836 A 11/1993 Tinawong
5,562,357 A 10/1996 Sandell
5,792,489 A * 8/1998 Liberman ..... E04F 21/1655 15/235.7

(Continued)

FOREIGN PATENT DOCUMENTS

CA 152737 S 7/2014
CA 172511 1/2018
CN 303156833 S 4/2015

OTHER PUBLICATIONS

"Plastic Corner Tool, Labelled—DCT" http://allwaytools.com/product/plastic-corner-tool-labelled-dct/ Allway Tools 2012 Catalog, p. 19. (Year: 2012).*

(Continued)

*Primary Examiner* — Laura C Guidotti
(74) *Attorney, Agent, or Firm* — Davis & Bujold PLLC; Michael J. Bujold

(57) ABSTRACT

A method of biasing a drywall corner flusher and a drywall corner flusher biased in accordance with the method. The method involves moulding a "V" shaped corner flusher body from a resilient material. The corner flusher body having a pair of blades each having a common edge and a remote edge, with the pair of blades being connected along the common edge. The corner flusher body is moulded with an integrally moulded undulating rib extending from the remote edge of one blade of the pair of blades to the remote edge of another blade of the pair of blades biasing the remote edge of each of the pair of blades outwardly.

8 Claims, 12 Drawing Sheets

(56) References Cited

U.S. PATENT DOCUMENTS

| | | | | |
|---|---|---|---|---|
| 6,113,301 | A | 9/2000 | Burton | |
| 6,155,809 | A | 12/2000 | Edwards et al. | |
| 6,247,868 | B1 | 6/2001 | Burton | |
| 7,114,869 | B2 * | 10/2006 | MacMillan | E04F 21/00 401/5 |
| 7,182,587 | B1 | 2/2007 | Raney | |
| D771,455 | S | 11/2016 | Ovens | |
| D773,912 | S | 12/2016 | Gringer et al. | |
| D790,297 | S | 6/2017 | Puusaag | |
| 10,087,640 | B2 * | 10/2018 | Kraskov | E04F 21/1655 |
| D848,805 | S | 5/2019 | Dombrowski | |
| 2005/0003682 | A1 | 1/2005 | Brazas | |
| 2005/0005386 | A1 | 1/2005 | MacMillan | |
| 2005/0106278 | A1 | 5/2005 | Hall et al. | |
| 2007/0206985 | A1 | 9/2007 | Daigle | |
| 2009/0041536 | A1 | 2/2009 | Cole | |
| 2009/0047882 | A1 | 2/2009 | Collins | |
| 2016/0116828 | A1 | 4/2016 | Clearman | |
| 2016/0221026 | A1 | 8/2016 | Despins et al. | |
| 2016/0341243 | A1 | 11/2016 | Ingrassia | |
| 2018/0187427 | A1 | 7/2018 | Dombrowski et al. | |

OTHER PUBLICATIONS https:l/cdn2.hubspot.netlhubfs/133874/Tool_Catalogue.pdf?utm_referrer=http%3A%2F%2Fwww.canamtool.com%2F Oct. 7, 2017 (Year: 2017).

* cited by examiner

METHOD OF BIASING A DRYWALL CORNER FLUSHER AND A DRYWALL CORNER FLUSHER

FIELD

There is described a novel method of biasing a drywall corner flusher and a drywall corner flusher that is biased in accordance with the teachings of the method.

BACKGROUND

Canadian Industrial Design Registration 172511 which registered on 23 Jan. 2018 depicts a prior art design of a drywall corner flusher, which uses a spring wire to exert a biasing force upon the distal ends of blades and feathering tabs to create a smooth minimal distribution of drywall compound to the corner joint. A smooth minimal distribution of drywall compound is desirable as it requires little sanding after it has solidified and prior to painting.

SUMMARY

According to one aspect there is provided a method of biasing a drywall corner flusher. The method involves moulding a "V" shaped corner flusher body from a resilient material. The corner flusher body having a pair of blades each having a common edge and a remote edge, with the pair of blades being connected along the common edge. The corner flusher body is moulded with an integrally moulded undulating rib extending from the remote edge of one blade of the pair of blades to the remote edge of another blade of the pair of blades biasing the remote edge of each of the pair of blades outwardly.

According to another aspect there is provided a drywall corner flusher, which has a "V" shaped corner flusher body moulded from a resilient material and having a pair of blades each having a common edge and a remote edge, the pair of blades being connected along the common edge. The corner flusher body having an integrally moulded undulating rib extending from the remote edge of one blade of the pair of blades to the remote edge of another blade of the pair of blades biasing the remote edge of each of the pair of blades outwardly.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1A:
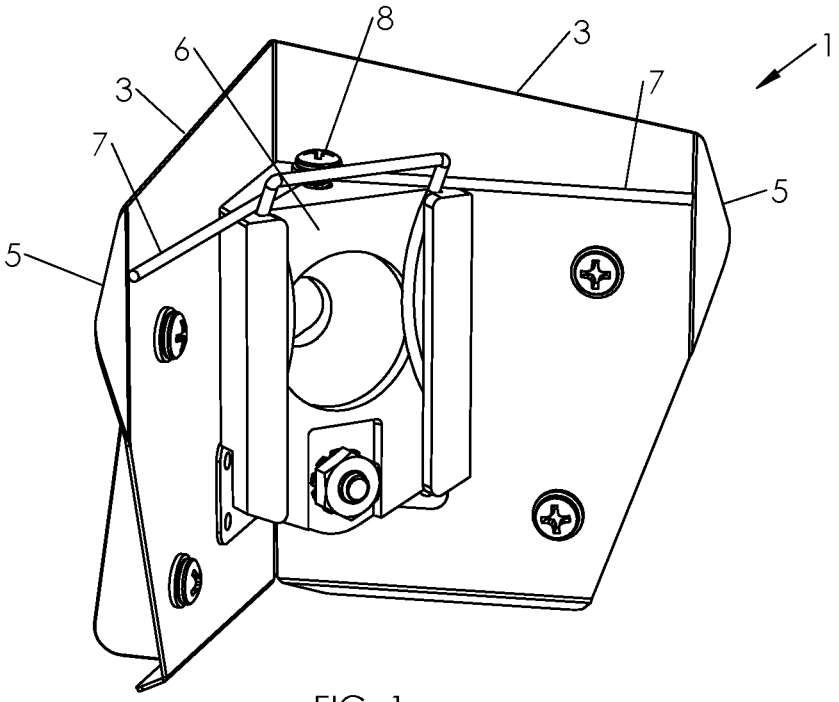
FIG. 1a Prior Art
FIG. 1*a*, labelled as PRIOR ART, is a front perspective view of a drywall corner flusher.
Figure 1B:
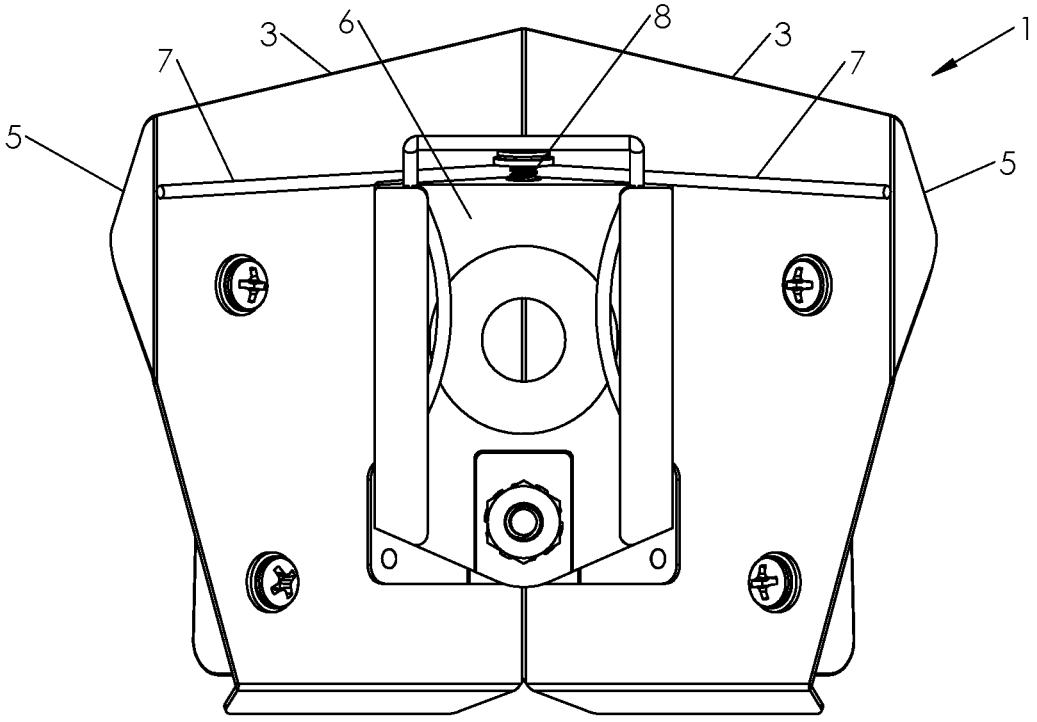
FIG. 1b Prior Art
FIG. 1*b*, labelled as PRIOR ART, is a front elevation view of the drywall corner flusher of FIG. 1*a*.
Figure 1C:
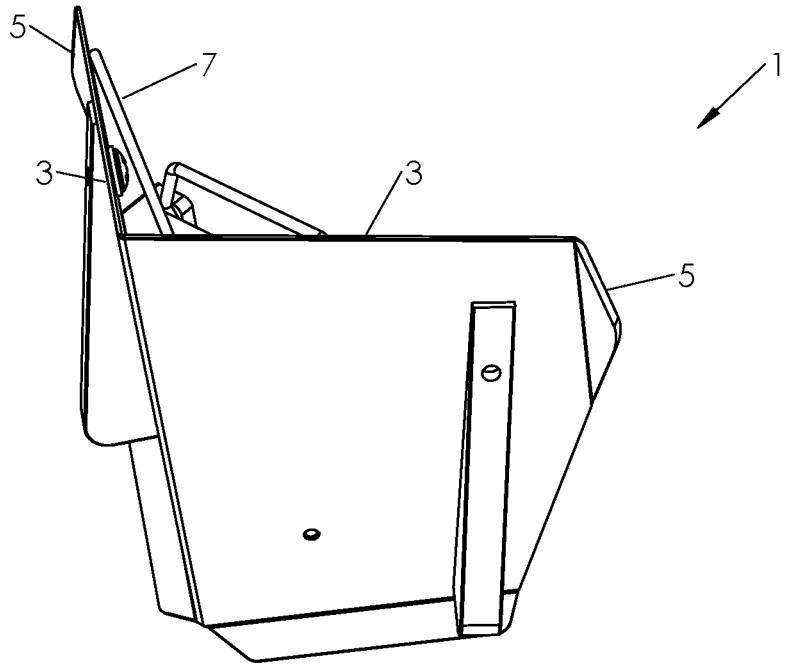
FIG. 1c Prior Art
FIG. 1*c*, labelled as PRIOR ART, is a rear perspective view of the drywall corner flusher of FIG. 1*a*.
Figure 1D:
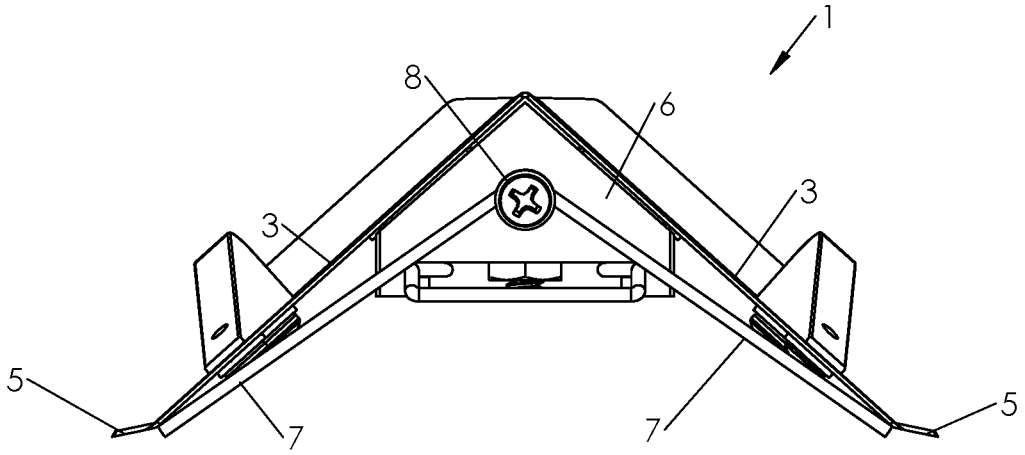
FIG. 1d Prior Art
FIG. 1*d*, labelled as PRIOR ART, is a top plan view of the drywall corner flusher of FIG. 1*a*.
Figure 2A:
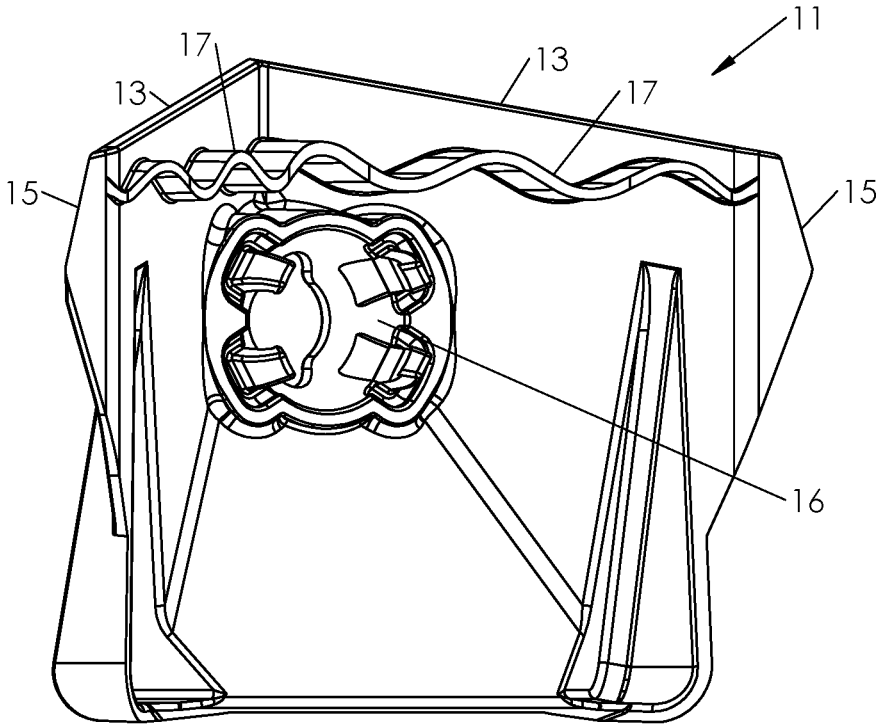
FIG. 2*a* is a front perspective view of a first embodiment of drywall corner flusher.
Figure 2B:
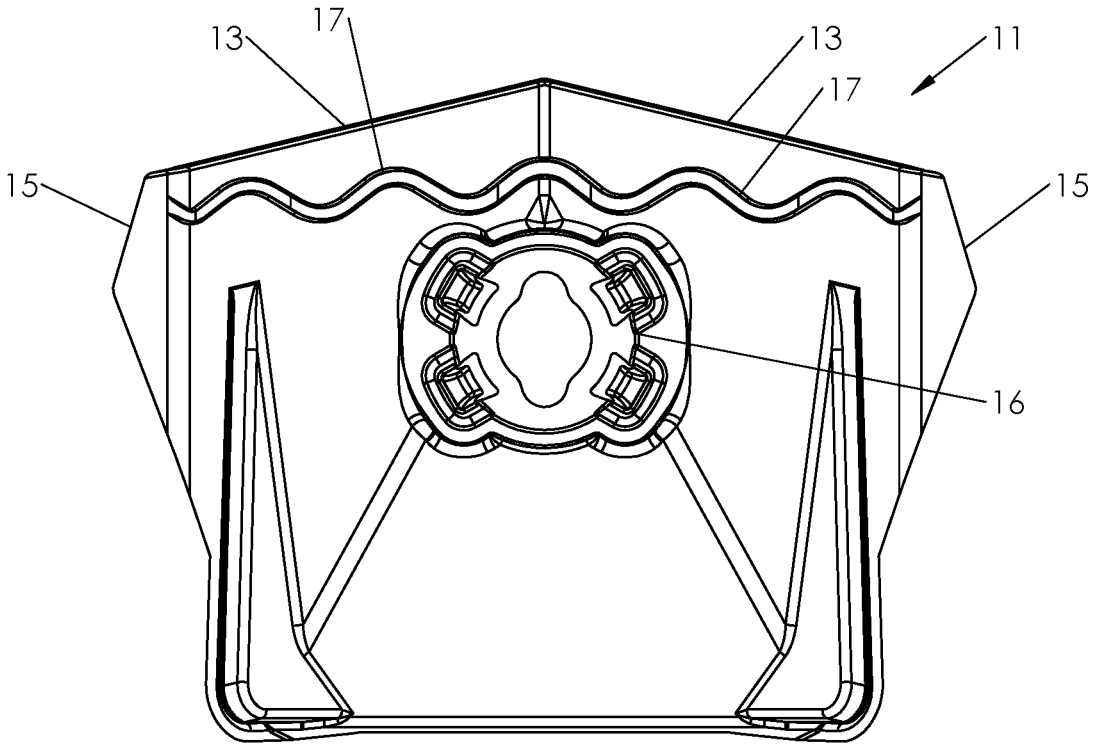
FIG. 2*b* is a front elevation view of the drywall corner flusher of FIG. 2*a*.
Figure 2C:
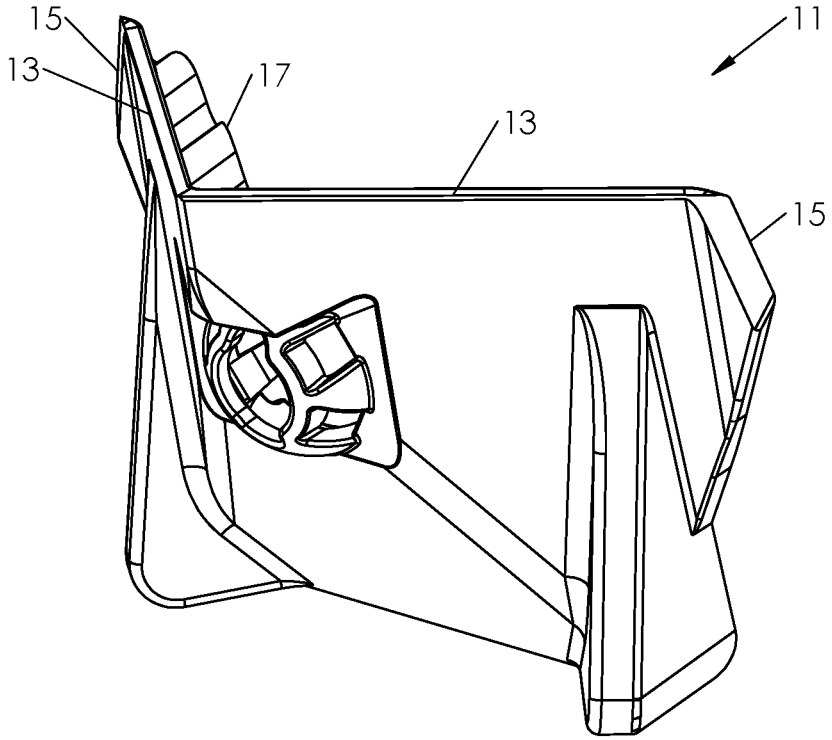
FIG. 2*c* is a rear perspective view of the drywall corner flusher of FIG. 2*a*.
Figure 2D:
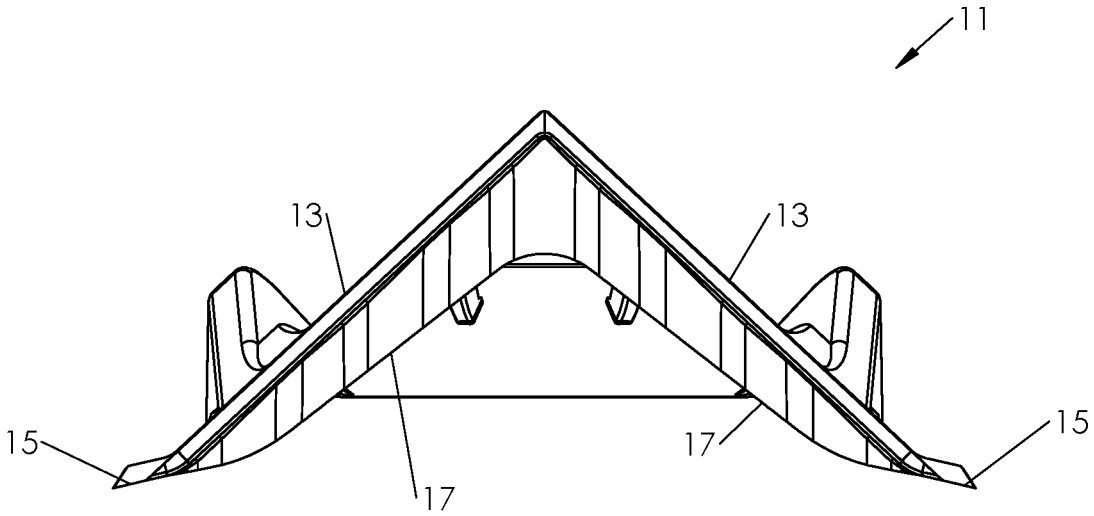
FIG. 2*d* is a top plan view of the drywall corner flusher of FIG. 2*a*.
Figure 3A:
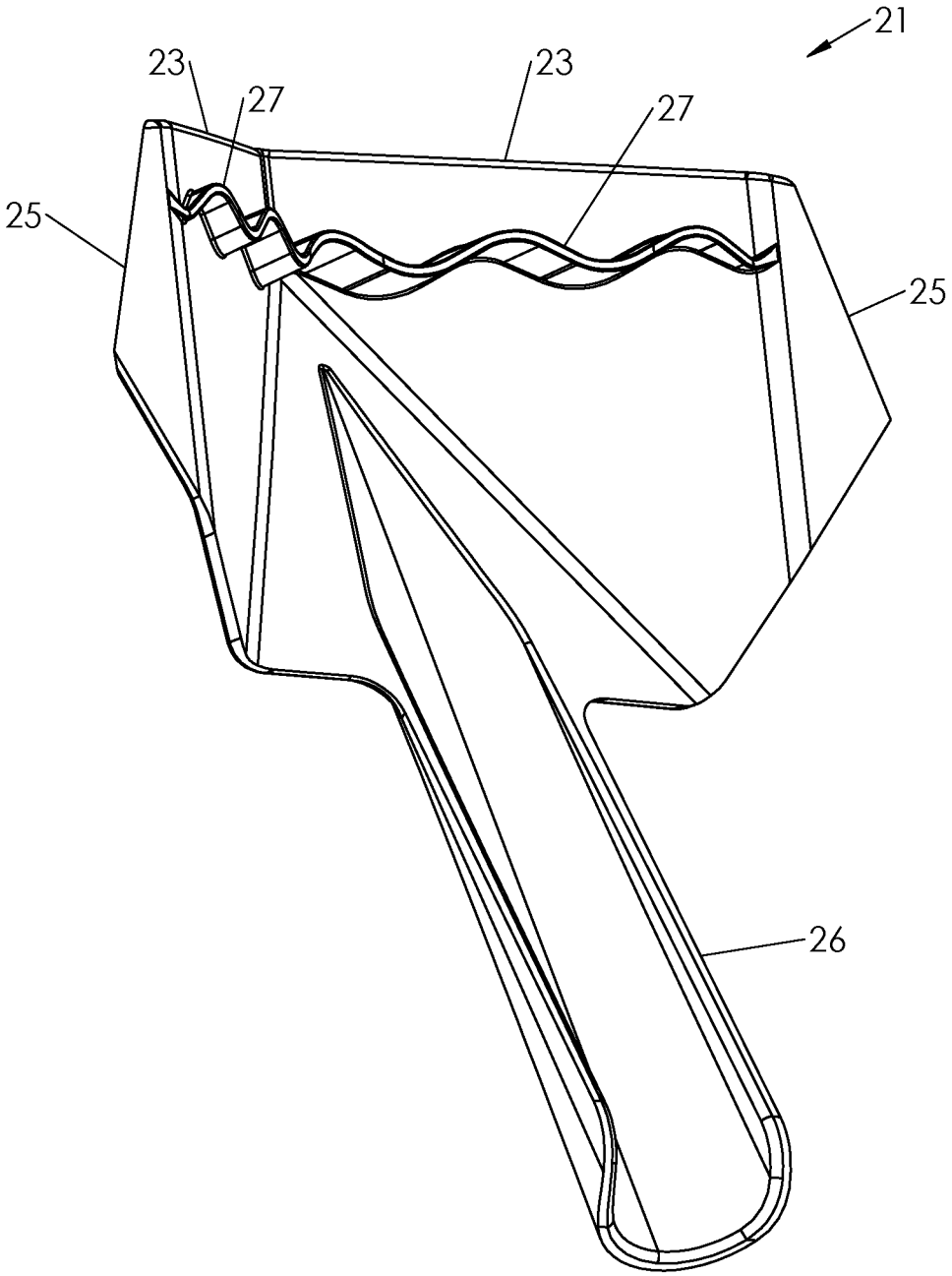
FIG. 3*a* is a front perspective view of a second embodiment drywall corner flusher.
Figure 3B:
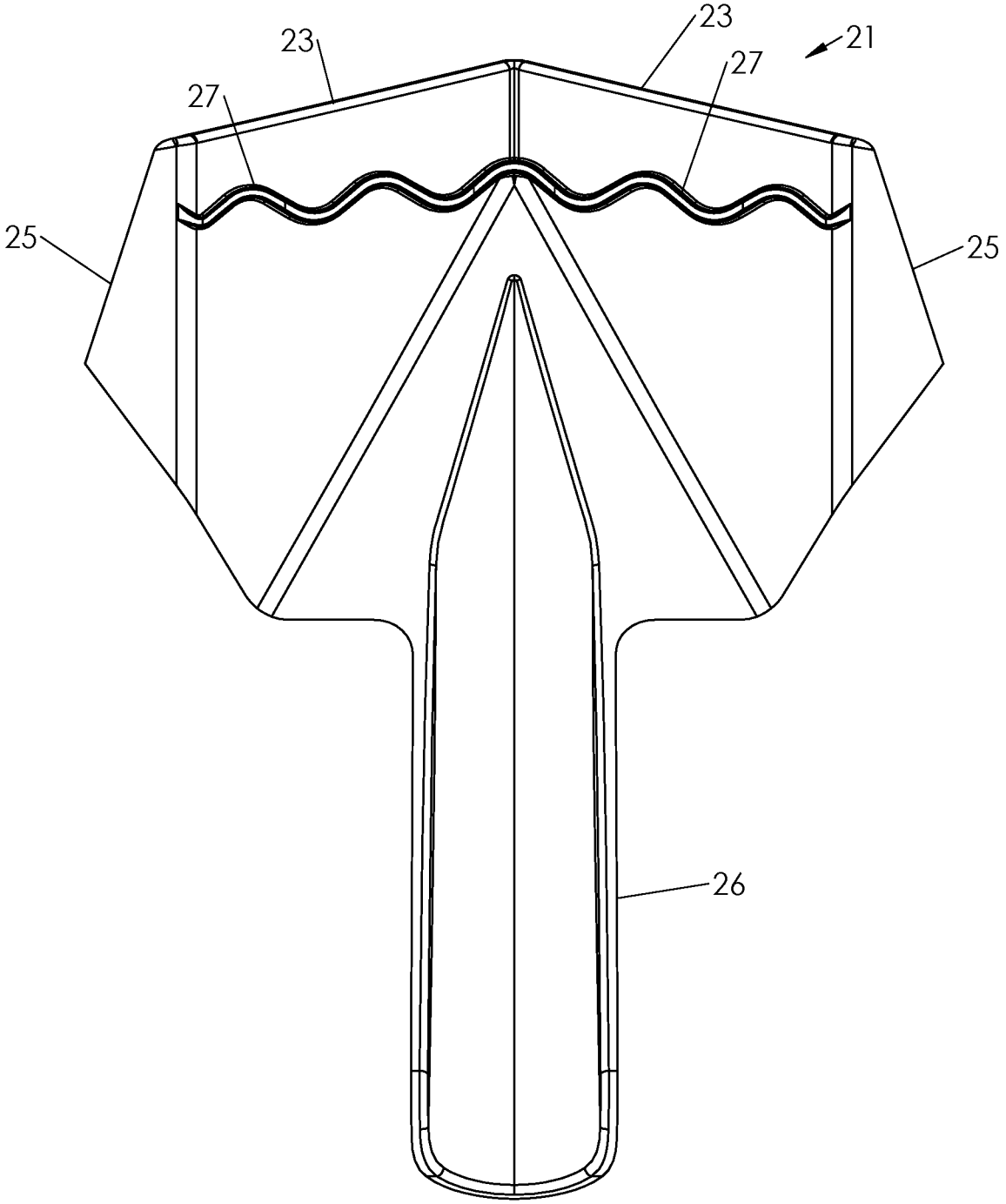
FIG. 3*b* is a front elevation view of the drywall corner flusher of FIG. 3*a*.
Figure 3C:
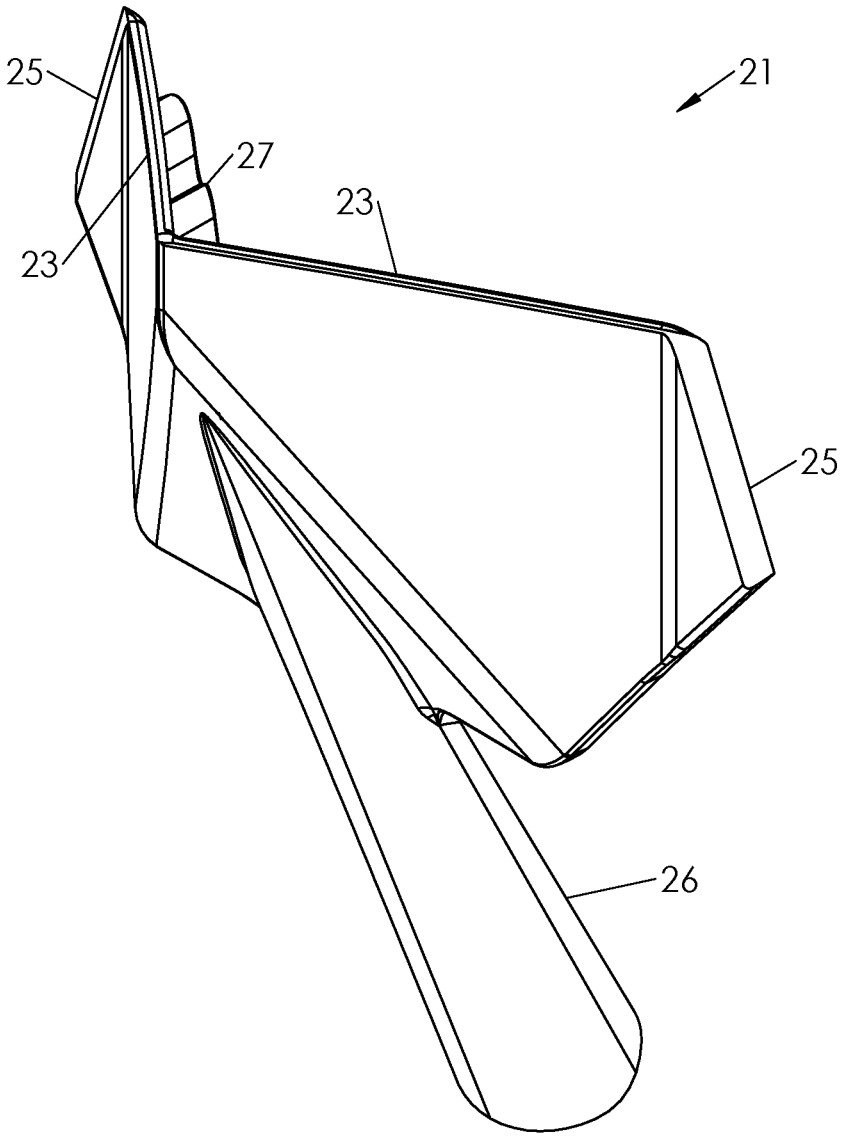
FIG. 3*c* is a rear perspective view of the drywall corner flusher of FIG. 3*a*.
Figure 3D:
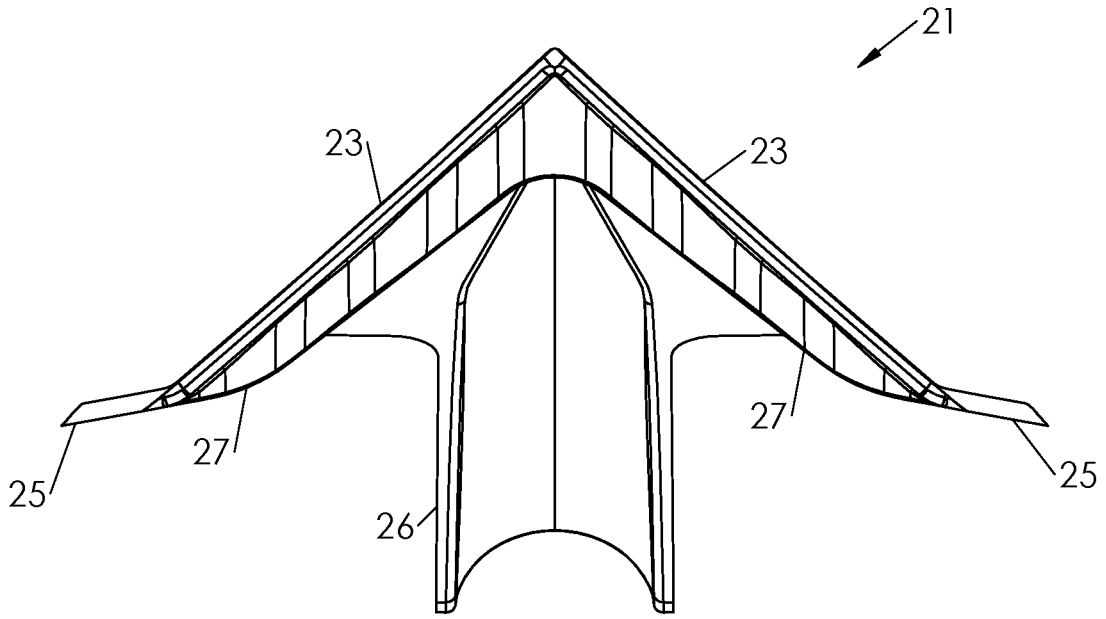
FIG. 3*d* is a top plan view of the drywall corner flusher of FIG. 3*a*.

A prior art drywall corner flusher, generally identified by reference numeral 1, will now be described with reference to FIG. 1*a* through FIG. 1*d*. A first embodiment generally identified by reference numeral 11, will now be described with reference to FIG. 2*a* through 2*d*. A second embodiment generally identified by reference numeral 21, will now be described with reference to FIG. 3*a* through 7*b*.

PRIOR ART

The prior art corner flusher 1 in FIGS. 1*a*-1*d* has blades 3 with feathering tabs 5. Spring wire 7 is mounted on ball socket 6 with screw 8 and biases blades 3 and tabs 5. When force is applied to socket 6 with a handle with a ball end (not shown), spring wire 7 exerts a biasing force on the distal ends of blades 3 and feathering tabs 5 ensuring contact with the drywall and sufficient applied force to the entire width of the blades 3 and feathering tabs 5 to create a smooth minimal distribution of drywall compound to the joint. A smooth minimal distribution of drywall compound requires little sanding after it has solidified and prior to painting. Blades 3 are at an angle slightly greater than that of the angle between the adjacent sheets of drywall that form the corner. Blades of the embodiments presented herein also have an angle slightly greater than the angle between the adjacent sheets of drywall that form the corner. Feathering tabs 5 limit compound from escaping to the sides of blades 3.

Embodiment with Ball Socket to Receive a Handle:

Corner flusher 11 in FIGS. 2*a*-2*d* is an illustrative embodiment of the invention. The plastic injection moulded part has blades 13, feathering tabs 15, and undulated rib 17. When force is applied to ball socket 16 with a handle with a ball end (not shown), undulated rib 17 exerts a biasing force on blades 13 and feathering tabs 15 enduring contact with the drywall and sufficient applied force to the entire width of the blades 13 and feathering tabs 15 to create a smooth minimal distribution of drywall compound to the joint. A smooth minimal distribution of drywall compound requires little sanding after it has solidified and prior to painting.

Embodiment with Integrally Formed Handle:

Hand corner flusher 21 in FIGS. 3*a*-3*d* is an illustrative embodiment of the invention. The plastic injection moulded part has blades 23, feathering tabs 25, and undulated rib 27. When force is applied to handle 26, undulated rib 27 exerts a biasing force on blades 23 and feathering tabs 25 enduring contact with the drywall and sufficient applied force to the entire width of the blades 23 and feathering tabs 25 to create a smooth minimal distribution of drywall compound to the joint. A smooth minimal distribution of drywall compound requires little sanding after it has solidified and prior to painting.

Figure 4A:
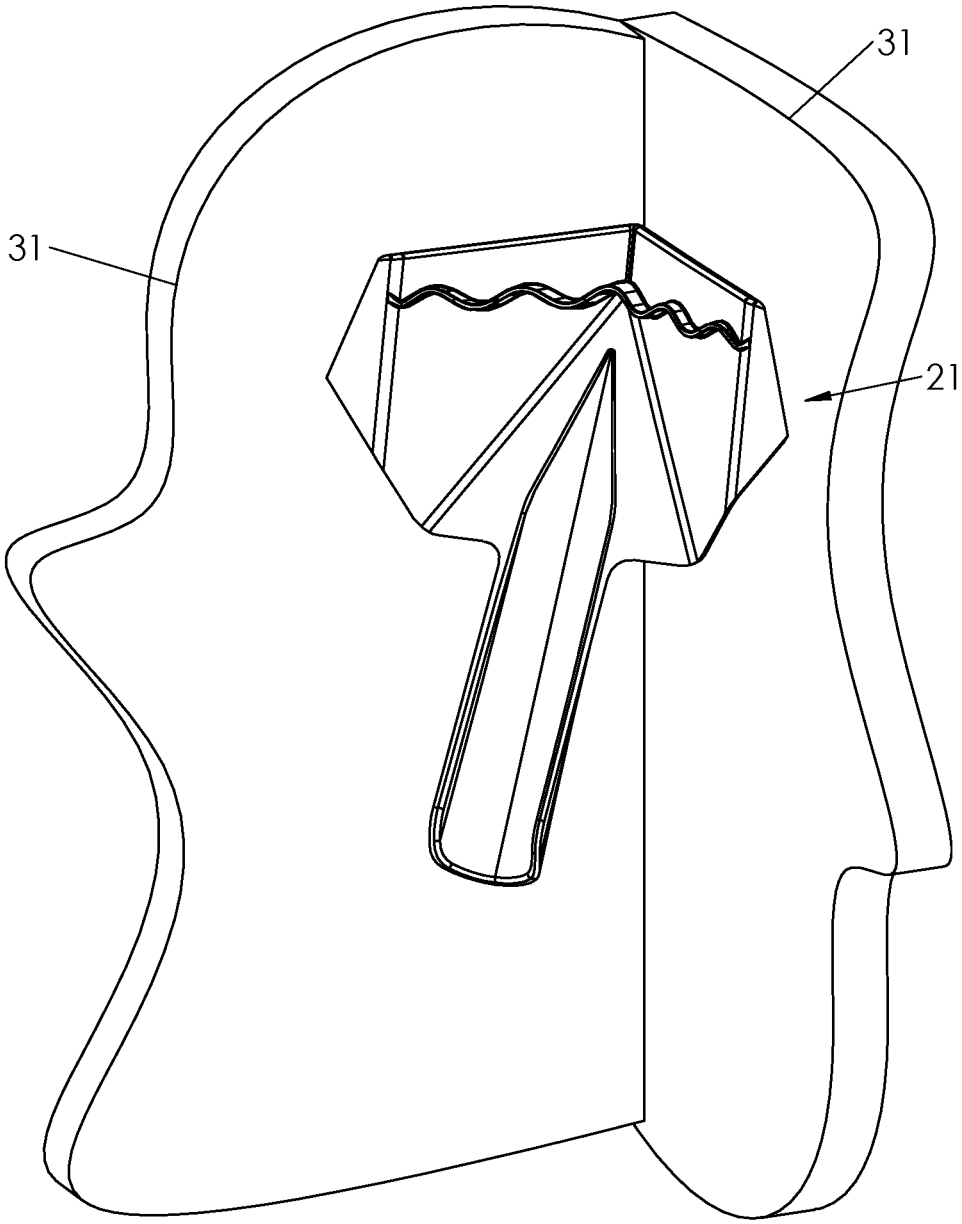
FIG. 4*a* is a perspective view of the second embodiment of drywall corner flusher illustrated in FIGS. 3*a*-3*d*, in a corner formed by adjacent cutaway sheets of drywall.
Figure 4B:
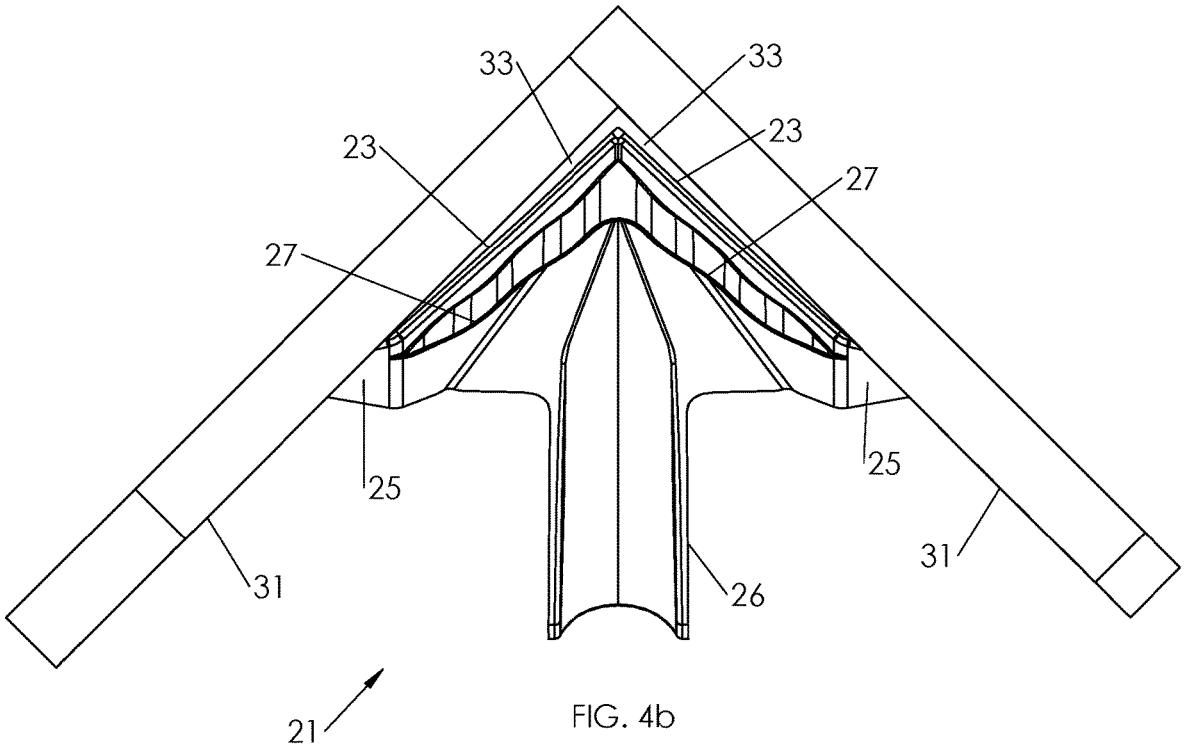
FIG. 4*b* is a top plan view of the drywall corner flusher of FIG. 4*a*, prior to being flexed into the corner.
Figure 5:
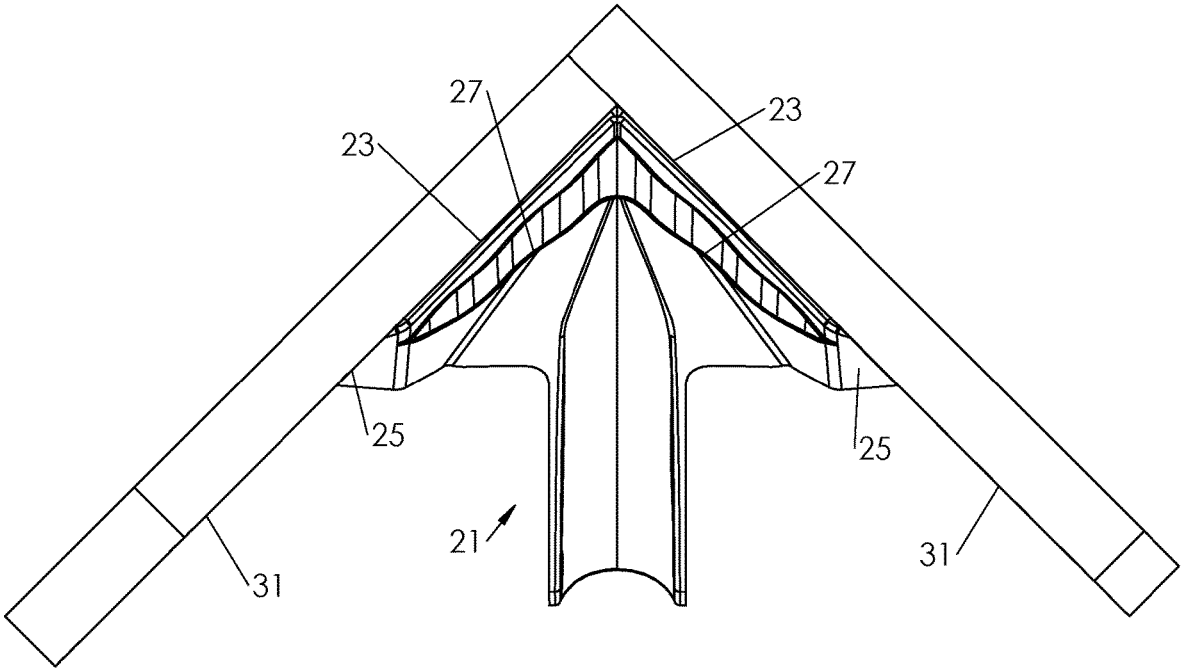
FIG. 5 a top plan view, similar to FIG. 4*b*, with the drywall corner flusher flexed into the corner.

Hand corner flusher 21, with only feathering tabs 25 touching drywall 31, prior to being compressed into the corner is shown in FIGS. 4*a*-4*b*. Gap 33 exists between blades 23 and drywall 31. While FIG. 5 shows hand corner flusher 21 being compressed into the corner formed by drywall 31. The gap between blades 23 and drywall 31 is eliminated. This ensures that a smooth minimal distribution of drywall compound is applied to the joint. Undulated rib 27 allows a force applied by a user to handle 26 to be transferred to blades 23 and feathering tabs 25. The force being sufficient for application of the drywall compound but not excessive for a user to apply.

Figure 6A:
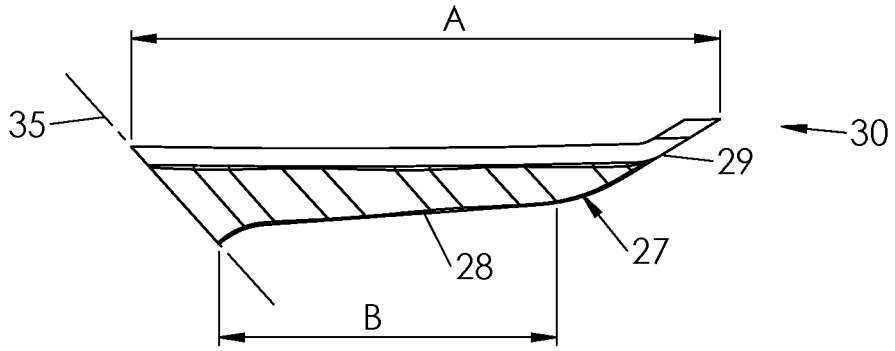
FIG. 6*a* shows a top view of an isolated portion of the flusher blade and undulated rib.
Figure 6B:
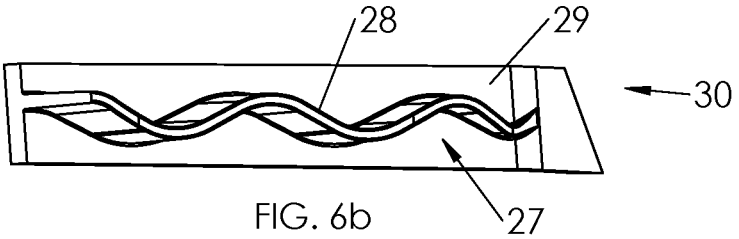
FIG. 6*b* shows the front view of FIG. 6*a*.
Figure 7A:
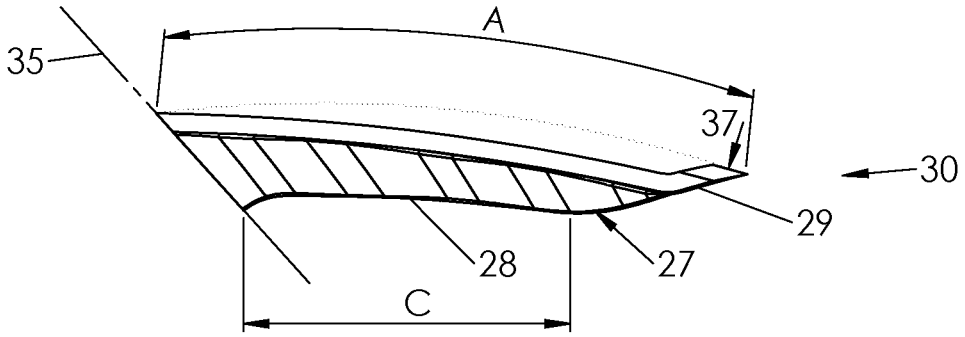
FIG. 7*a* shows a top view of the isolated portion of the flusher blade and undulated rib shown in FIGS. 6*a*-6*b* under load in a flexed state.
Figure 7B:
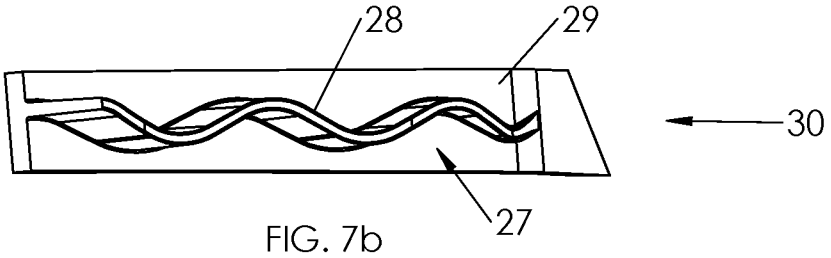
FIG. 7*b* shows the front view of FIG. 7*a*.

An isolated portion of flusher 30, truncated from flusher 21 along axis of symmetry 35 and on either side of the undulated rib 27, prior to flexion is shown in FIGS. 6*a*-6*b*. The un-flexed length "A" of blade 29 is shown. Length "B" is the un-flexed length of a portion of distal edge 28 of undulated rib 27. The isolated portion of flusher 30 is shown in a flexed state in FIGS. 7*a*-7*b*. The flexed arc length "A" of blade 29 remains the same as in the un-flexed state. Length "C" is the flexed length of the same portion of distal edge 28 of undulated rib 27. Length "C" is shorter than length "B" due to the compression of distal edge 28; the undulations of distal edge 28 are closer together.

Advantages

The undulated rib as part of a corner flusher replaces a wire form spring or flat form spring on prior art corner flushers. A biasing element injection moulded as part of the flusher has the following benefits over the prior art:

It has fewer parts,

It eliminates assembly labour,

It is less expensive because plastic is cheaper than metal and

It is lighter weight because plastic weighs less than metal.

A straight rib could be used, however, a straight rib does not provide the same flex characteristics as an undulated rib. The straight rib provides excessive resistance to flexion until it flexes out of plane then the resistance to flexion decreases. An undulated rib has the advantage of deflecting with a more constant and lower resistance because the rib is effectively "out of plane" in its unloaded state.

The undulated rib in the disclosed embodiment allows for injection moulding without undercuts or the need for mould specialty release mechanisms like side-action or collapsible cores. These mechanisms increase the cost and maintenance of the mould and reduce cycle time. The undulated rib is used, rather than increasing the thickness of the blades, to limit the amount of plastic material used and to keep a uniform and limited wall thickness as is required in injection moulding to limit sinks and warpage.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A method of manufacturing a drywall corner flusher, the method comprising:

moulding a "V" shaped corner flusher body from a resilient material, providing the corner flusher body having with a pair of blades each having a common edge and a remote edge, connecting the pair of blades along the common edge, extending an integrally moulded undulating rib from the remote edge of one blade of the pair of blades to the remote edge of another blade of the pair of blades for biasing the remote edge of each of the pair of blades outwardly.

2. The method of claim 1, wherein the resilient material from which the corner flusher body is made is a polymer plastic.

3. The method of claim 1, wherein feathering tabs are positioned along the remote edge of each of the pair of blades.

4. A drywall corner flusher, comprising:

a "V" shaped corner flusher body moulded from a resilient material and having a pair of blades each having a common edge and a remote edge, the pair of blades being connected along the common edge; and an integrally moulded undulating rib extending from the remote edge of one blade of the pair of blades to the remote edge of another blade of the pair of blades biasing the remote edge of each of the pair of blades outwardly.

5. The drywall corner flusher of claim 4, wherein the resilient material from which the corner flusher body is made is a polymer plastic.

6. The drywall corner flusher body of claim 4, wherein feathering tabs are positioned along the remote edge of each of the pair of blades.

7. The drywall corner flusher of claim 4, wherein the corner flusher body has a ball socket positioned behind the common edge, wherein a ball end of a handle is received.

8. The drywall corner flusher of claim 4, wherein the corner flusher body has an integrally moulded depending handle.

* * * * *